United States Patent [19]

Engels

[11] 4,117,981

[45] Oct. 3, 1978

[54] STIRRING MILL

[75] Inventor: Kaspar Engels, Mannheim, Germany

[73] Assignee: Draiswerke GmbH, Mannheim-Waldhof, Germany

[21] Appl. No.: 811,183

[22] Filed: Jun. 29, 1977

[30] Foreign Application Priority Data

Jul. 14, 1976 [DE] Fed. Rep. of Germany ..... 2631623

[51] Int. Cl.[2] ..... B02C 23/16

[52] U.S. Cl. ..... 241/46.15; 241/79.3; 241/172

[58] Field of Search ..... 241/46.06, 46.11, 46.15, 241/46.17, 68, 79, 79.2, 79.3, 172, 173

[56] References Cited

U.S. PATENT DOCUMENTS 3,311,310 3/1967 Engels et al. ..... 241/172

3,720,379 3/1973 Szeguari ..... 241/46.15

*Primary Examiner*—Granville Y. Custer, Jr.

*Attorney, Agent, or Firm*—Browdy and Neimark

[57] ABSTRACT

A stirring mill for fine grinding and/or dispersal of flowable grinding stock in whose grinding container a mixing shaft provided with mixing members is rotatably drivably mounted. The grinding container is provided with a grinding-stock inlet and a ground-stock outlet. A separating device is provided in the vicinity of the ground stock outlet, the separating device being formed by annular disks mounted concentrically on a shaft. The disks are rotatable relative to one another and define radial spaces between one another. Between each two axially nondisplaceable annular disks, an axially freely movable annular disk is located. The sum of the widths of the two spaces delimited by an axially movable annular disk is smaller than the diameter of the smallest unit of grinding medium.

16 Claims, 7 Drawing Figures

STIRRING MILL

BACKGROUND OF THE INVENTION

This invention relates to a stirring mill for fine grinding and/or dispersal of flowable grinding stock. The present invention relates more particularly to such a stirring mill which includes a grinding container with a rotatably drivable shaft equipped with stirring members. The grinding container is provided with a grinding-stock inlet in the vicinity of one end and a ground-stock outlet in the vicinity of the other end. A separating device is disposed in front of the ground-stock outlet to retain grinding media located in the grinding container, the separating device being formed by annular disks disposed concentrically on a shaft, the disks being rotatable relative to one another and forming radial spaces between them. The width of the spaces is less than the diameter of the smallest unit of grinding media.

A stirring mill of the above-mentioned type is known from U.S. Pat. No. 3,311,310 wherein a radial space is formed by an annular disk fitting around a mixer shaft and an opposing ring mounted immovably on a grinding container, the width of the space being adjustable. This mixing device in which a grinding effect is also produced simultaneously in the spaces, has proven to be extraordinarily satisfactory; however, problems arise when adjusting the space width.

German Offenlegungsschrift (Laid Open Patent Application) No. 1,507,493 likewise discloses a stirring mill of the type described hereinabove, in which an annular disk is disposed between two opposing rings mounted immovably in the grinding container, the annular disk being connected nonrotatably with the mixing shaft and being adjustable axially relative to the shaft. The disk delimits spaces arranged in parallel relative to the opposing rings. Here agains problems arise in adjusting the opposing rings.

German Auslegeschrift (Published Patent Application) No. 2,112,605 discloses a stirring mill in which a radial space is formed between an opposing ring mounted immovably opposite a grinding container and an annular disk. The annular disk is mounted immovably relative to a shaft separate from the mixing shaft, the annular disk being provided with driving means in the form of propeller blades, so that it can rotate freely with flow of grinding stock.

German Auslegeschrift (Published Patent Application) No. 2,446,341 discloses a stirring mill in which a packet of annular disks arranged concentrically relative to one another is provided as a separating device to hold back the grinding media. The disks delimit radially extending spaces; an annular disk is always mounted immovably and alternately in the grinding container, while the other annular disks can be set oscillating by a vibrating drive.

German Offenlegungsschrift (Laid Open Patent Application) No. 1,757,953 discloses a stirring mill in which a rotating screen in the form of a hollow body is provided as the separator. The purpose of the rotational movement of the screen is to prevent clogging of the screen by the grinding media.

SUMMARY OF THE INVENTION

The principal object of the present invention is to provide a stirring mill of the type described hereinabove in such manner that the necessity of adjusting the width of the spaces is eliminated.

The foregoing object, as well as others which are to become clear from the text below, is achieved according to the present invention by virtue of the fact that an axially freely movable annular disk is mounted between each two axially nondisplaceable annular disks, the sum of the widths of the two spaces delimited by the axially movable annular disk being less than the diameter of the smallest unit of grinding media. This measure ensures that at least one annular disk is mounted in a floating manner between each two axially nondisplaceable annular disks, so that the two spaces delimited by it can adjust freely. Only the maximum width of the space is delimited, i.e., the space width can be adjusted freely between a value of zero and the maximum width of the space.

Advantageously, the distance between the two adjacent axially nondisplaceable annular disks can be determined by interchangeable spacing rings, i.e., if grinding media with considerably different diameters are to be used in a stirring mill, only these spacing rings need be exchanged; thus, the maximum space widths suitable for the new grinding media can be set.

The measures according to the invention result in a number of possibilities for producing relative movement between the axially freely movable and the axially nondisplaceable annular disks. According to an especially simple and further improved variant, the axially nondisplaceable annular disks are nonrotatably connected to the shaft supporting them, in a manner known per se. Furthermore, it is highly advantageous if the axially movable annular disks are freely rotatable relative to the shaft supporting them. In this regard, they can either be freely rotatable relative to the grinding container, or can be mounted nonrotatably relative to the grinding container.

Advantageously, the annular disks which are freely rotatable relative to the shaft have a greater diameter than the annular disks which are not freely rotatable. In this manner, a situation is established in which the rotatable disks are given a rotary movement by the rotating flow of grinding stock, but in every case this movement is different from that of the annular disks which are not freely rotatable. The latter either stand still or are driven. If the annular disks which are not freely rotatable are forcibly driven by the shaft supporting them, the annular disks which have a greater diameter and are axially and tangentially freely movable are braked in the flow of grinding stock relative to the driven annular disks, while in the case in which the annular disks which are not freely rotatable are standing still, they are driven relative to the latter. If the axially freely movable annular disks are provided with driving elements at their outer circumference, their circumferential velocity will be approximately the same as that of the rotating flow of grinding stock acting on the drivers.

The annular disks can be mounted in known fashion on the mixing shaft or on a separate shaft from the mixing shaft. In the latter case, the arrangement of the separate shaft relative to the mixing shaft is optional, and in particular the separate shaft can be arranged at an angle to the mixing shaft. In an advantageous further embodiment of the invention, it is possible to drive the separate shaft through the mixing shaft. Of course, a separate drive can also be provided. Finally, it is also possible to allow the separate shaft to stand still and to advance it slightly now and again by hand, or even to make it nonrotatable.

BRIEF DESCRIPTION OF THE DRAWING

Further advantages and features of the invention are to become apparent from the description of exemplary embodiments with reference to the drawing.

DETAILED DESCRIPTION OF THE PREFERRED EMBODIMENTS

Figure 1:
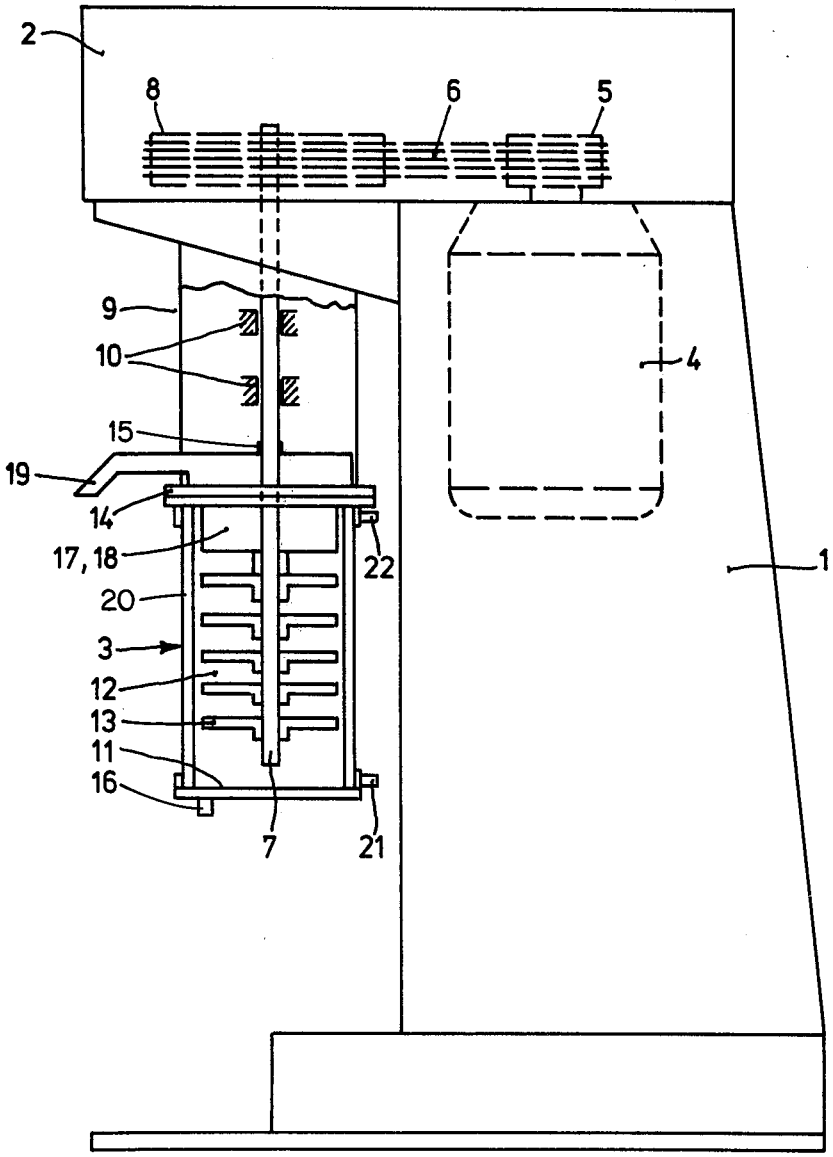
FIG. 1 is a somewhat diagrammatic, side view of a stirring mill provided with a separating device according to the present invention.

The stirring mill shown in FIG. 1 is provided in conventional fashion with a base 1, having a projecting bracket 2 mounted on its upper end, to which a cylindrical grinding container 3 is mounted in turn. An electric drive motor 4 is located within the base 1, this motor being provided with a V-belt pulley 5, by which a V-belt pulley 8 nonrotatably connected to a mixing shaft 7 is rotatably drivable via a V-belt 6.

The mixing shaft 7 is mounted in suspended fashion in a bearing housing 9 located on the underside of the bracket 2 by two bearings 10, i.e., it is not mounted at its free end in the vicinity of a bottom 11 of the grinding container 3. The mixing shaft 7 is provided with mixing tools 13 inside the grinding container 3, in other words in a grinding space 12 of the latter. The grinding container 3 is closed at its upper end by a cover 14, this cover being sealed with respect to the mixing shaft 7 by a seal 15 conventional in machines of this type, this seal being for example a stuffing box seal. A grinding stock inlet connection 16 terminates at the bottom of the grinding space 12, this connection serving for supply of the grinding stock to be ground and dispersed. In the upper part of the grinding container 3, the grinding space 12 is separated from a grinding stock removal space 17 by means of a separating device 18, embodiments of which are to be described in greater detail below. A ground-stock outlet pipe 19 is mounted on the cover 14, so that the completely processed ground stock can pass out through this pipe from the ground-stock removal space 17 and thence out of the stirring mill. The grinding container 3 can be provided with a cooling jacket 20, into which cooling water is supplied through a lower cooling water inlet connection 21 and from which water can be removed through an upper cooling water outlet connection 22.

Figure 2:
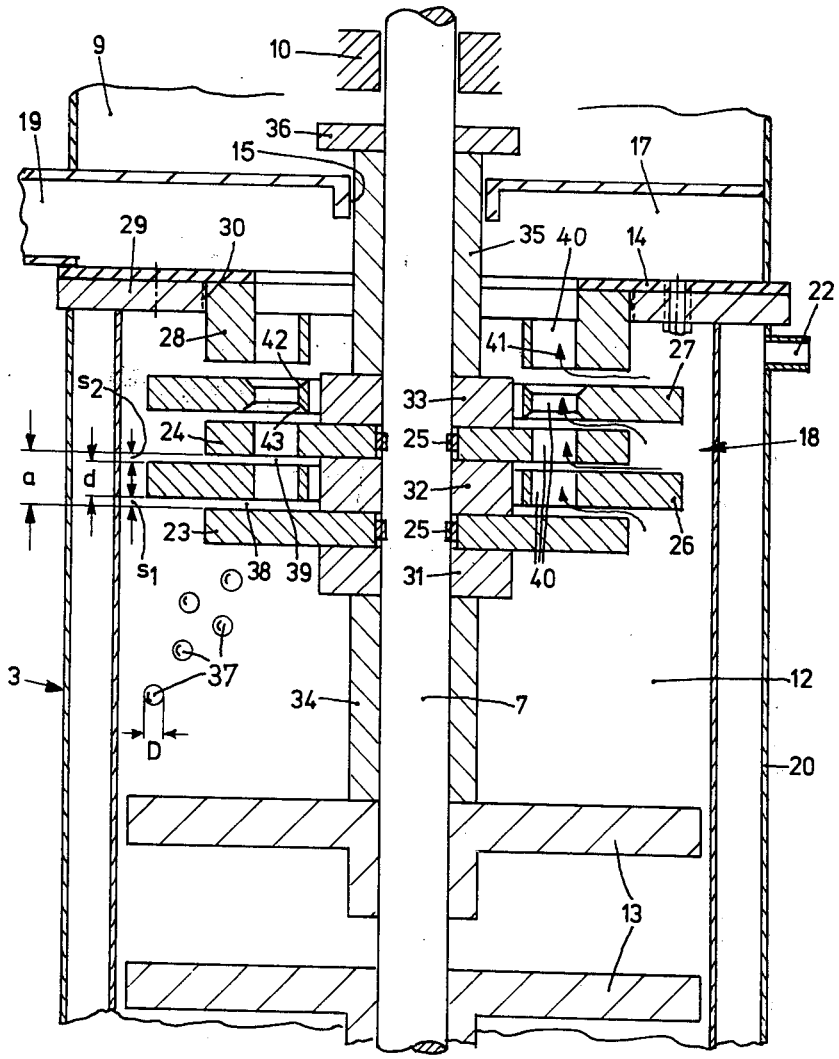
FIG. 2 is an axial cross-sectional view of a first embodiment of a separating device mounted on a mixing shaft.

In the separating device 18 as shown in FIG. 2, a plurality of annular disks are disposed on the mixing shaft 7, with annular disks 23 and 24 being nonrotatably connected with the mixing shaft 7 by means of a key connection 25. Annular disks 26 and 27 are likewise respectively mounted concentrically relative to the mixing shaft 7 between the two annular disks 23 and 24 and above the upper nonrotatable annular disk 24, these annular disks being movable radially and axially with respect to the mixing shaft 7, and being freely rotatable relative to the mixing shaft 7. An immovable annular disk 28 is provided above the upper annular disk 27, this disk being movable relative to the mixing shaft 7 and the annular disk 28 being screwed into a cover-like lower sealing wall 29 of ground stock-removal space 17 by means of a thread 30. The cover-like lower sealing wall 29 is screwed onto the underside of the cover 14. The annular disks 23, 24, connected nonrotatably with the mixing shaft 7, are also immovable axially relative to the mixing shaft 7, by means of spacing rings 31, 32, 33 and spacing bushings 34, 35 delimiting them above and below. The lower spacing bushing 34 rests on the uppermost one of the mixing tools 13, while the upper spacing bushing 35 is mounted axially for example by a clamping ring 36. The entire assembly, or packet, consisting of the annular disks 23, 24, the spacing rings 31, 32, 33 and the spacing bushings 34, 35 is therefore axially nondisplaceable relative to the mixing shaft 7. The amount of axial mobility of the annular disks 26, 27 is determined by the difference in interval $a$ between two adjacent axially nondisplaceable annular disks 23, 24 and/or 24, 28 and the axial thickness $d$ of the annular disks 26, 27, these disks being axially freely movable between the latter. During operation, the axially displaceable annular disks 26, 27 are pushed apart by liquid films which build up as a result of relative movement of these disks relative to disks 23, 24;, so that radial spaces with axial heights $s_1$ and/or $s_2$ are formed, in each case, between the annular disk 26 and/or 27 and the adjacent axially nondisplaceable annular disks 23, 24, and/or 24, 28. On the basis of the above explanation, the following relationship then follows: $s_1 + s_2 = a - d$.

The grinding space 12 is filled in the usual fashion about 50 to 70% with a grinding media 37, of which only a few particles are shown in FIG. 2 for the sake of clarity. The diameter D of these particles of grinding media 37 is in the 0.2 to 3 mm range. The following relationship is also valid: $s_1 + s_2 < D_{min}$, where $D_{min}$ is the diameter of the smallest unit of the particles of grinding media 37 located at a given time in the grinding space 12. Usually, $s_1 + s_2 < 0.7 \times D_{min}$.

The outside diameter of the axially freely movable annular disks 26, 27 which are freely rotatable relative to the mixing shaft 7 is substantially greater than the diameter of the axially nondisplaceable annular disks 23, 24, 28, so that the former are braked relative to the disks 23, 24 by the flow of grinding stock, i.e., they acquire a much lower rpm than the annular disks 23, 24, 28 which are nonrotatably connected to the mixing shaft 7.

On the basis of this dimensioning, the particles of grinding media 37 are reliably prevented from penetrating annular spaces 38, 39 defined between the annular disks 23, 24, 26, 27, 28. With the exception of the annular disk located behind the grinding space 12, in other words the lower annular disk 23, all of the other annular disks 24, 26, 27, 28 have a respective plurality of apertures 40 through them, so that the grinding stock flowing from the grinding space 12 into the annular spaces 38 and/or 39 along flow direction arrows 41, after passing through the spaces 38, 39 can flow freely into the ground-stock removal space 17. The number of apertures in each disk 24, 26, 27, 28 are equal in size and number and are positioned substantially equal distances from the shaft 7. The radial play between the axially movable annular disks 26, 27 and the corresponding spacing rings 32, 33 is at least large enough so that the annular disks 26, 27 can rotate freely. The radial play, moreover, must be greater than the amplitude of the bending oscillations of the mixing shaft 7 during high-speed revolution because it is mounted in bearings 10 and is free at its end in the vicinity of the bottom 11.

The apertures 40 provided in the axially movable annular disks 26, 27 can be provided with enlargements 42 and/or 43, enlarging toward the upper or lower sides of the corresponding annular disks, by which expansions the equalization of pressure between the two annular spaces 38 and 39 delimiting an annular disk 26 and/or 27 is facilitated, so that the upward movement of the axially movable annular disks 26, 27 is facilitated. This is so, it is believed because the pressure fields work from both above and below movable disks 26, 27 in the vicinity of the enlargements 42, 43 and when the disks 26, 27 are axially displaced the space below these disks increases and the pressure gradient decreases until equilibrium is established. The enlargements 42, 43 reduce any abrupt change in the pressure gradient. As is evident from FIG. 2, the apertures 40 in the various annular disks 26, 24, 27, 28 are at the same radial distance from the shaft 7. In addition, the distance between two adjacent apertures 40 provided in an annular disk is always smaller than the diameter of an aperture 40 is an adjacent annular disk, so that the apertures 40 in the annular disks arranged in sequence always overlap one another.

Figure 3:
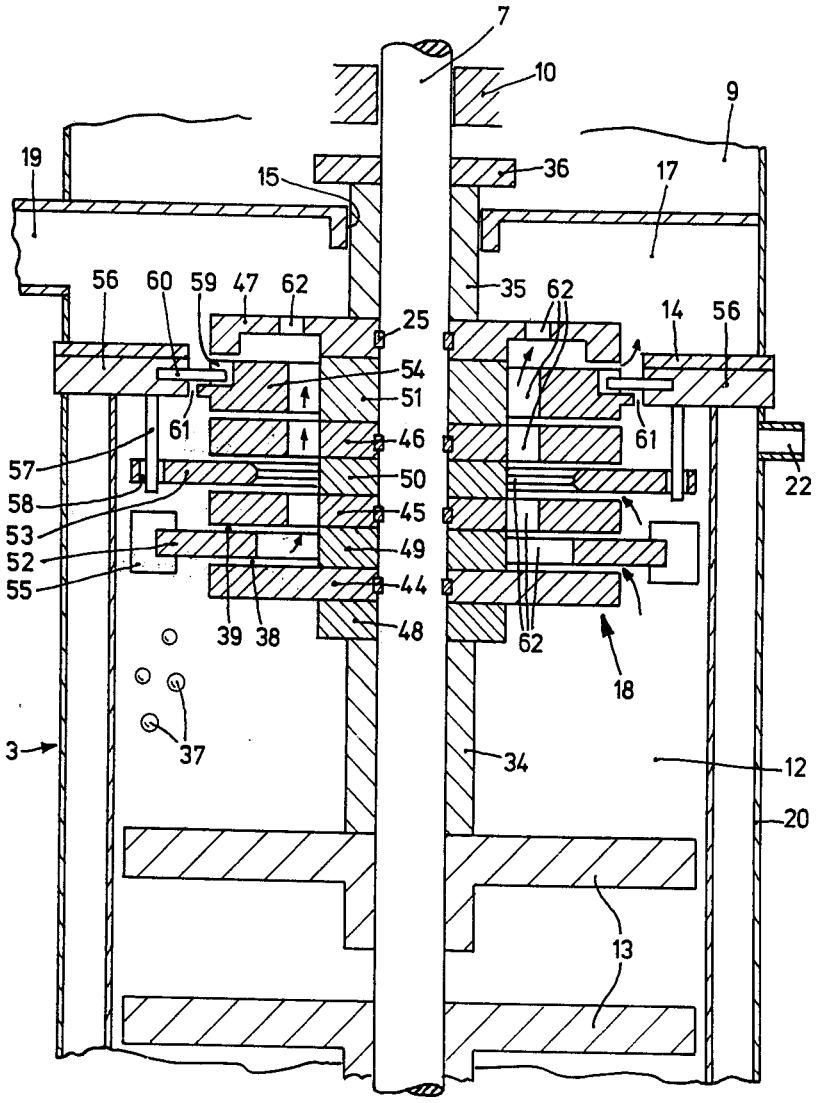
FIG. 3 is an axial cross-sectional view of a second embodiment of a separating device mounted on a mixing shaft.

In the separating device 18 according to FIG. 3, a plurality of annular disks 44, 45, 46, 47 are once again connected nonrotatably with the mixing shaft 7 by means of a key connection 25, these disks also being mounted axially relative to the mixing shaft 7 by the spacing bushings 34, 35 and spacing rings 48, 49, 50, 51 in similar fashion to the embodiment illustrated in FIG. 2. Between each two adjacent axially nondisplaceable annular disks 44, 45 and/or 45, 46 and/or 46, 47, in each case an annular disk 52 or 53 or 54 is disposed, this annular disk being freely movable axially relative to the mixing shaft 7. The same dimensional relationships set forth for the embodiment shown in FIG. 2 apply to the width of the annular spaces 38, 39 shown in FIG. 3.

The lower axially freely movable annular disk 52 is likewise freely rotatable relative to the mixing shaft 7 and relative to the grinding container 3, and is provided on its outer circumference with one or more paddle-like drivers 55, by which the annular disk 52 receives a circumferential velocity during operation of the stirring mill, the velocity roughly corresponding to the rotational velocity of the grinding stock rotating in the grinding container 3, i.e., the rpm of the axially freely rotatable annular disks 52, 53, 54 is much lower than the rpm of the annular disks 44 to 47.

The influence of liquid friction in the annular spaces 38 or 39 upon the circumferential velocity is largely eliminated. The two other axially freely movable annular disks 53, 54 can be nonrotatably mounted relative to grinding container 3, i.e., tangentially; in this case, their rpm would be zero. A holding pin 57, extending axially parallel to the mixing shaft 7, is provided on a cover-like lower sealing wall 56 of the grinding space 17, the pin 57 meshing with a corresponding hole 58 in the annular disk 53. In the case of the upper axially displaceable annular disk 54, a recess 59 is provided in the vicinity of its outer circumference, into which a holding pin 60 fits radially, this pin being fastened to the lower sealing wall 56. On the one hand, the axially freely movable annular disks 52, 53, 54 are mounted with relatively large radial play, i.e. radially floating, on the spacing rings 49, 50, 51. On the other hand, the holding pin 57 or the holding pin 60, is disposed with appropriately large radial play in hole 58 or the recess 59. The radial extent of an axially extending space 61 between the annular disk 54 and the corresponding wall of the lower sealing wall 56 must naturally also be smaller than the diameter of the smallest particle of the grinding medium 37 used.

In this second embodiment as well, with the exception of the lower annular disk 44, the annular disks 52, 45, 53, 46, 54, 47 are provided with apertures 62, through which the grinding stock after passing through one of the spaces 38, 39 can flow freely into the grondstock removal space 17.

Figure 4:
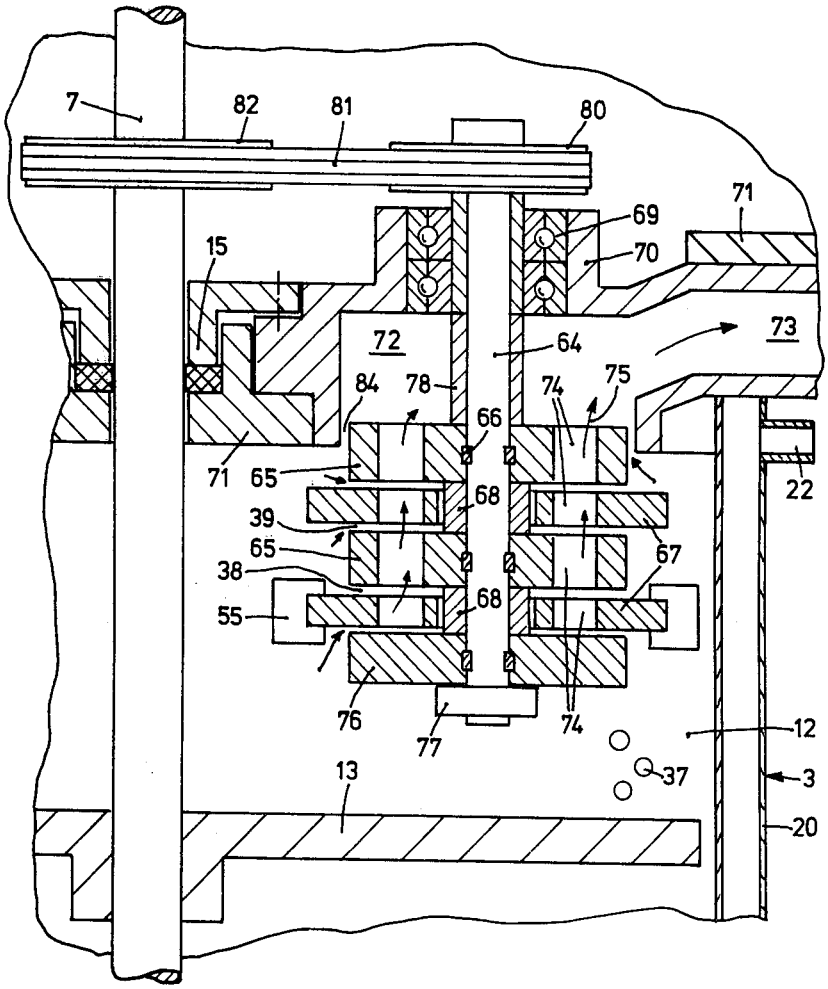
FIG. 4 is an axial cross-sectional view of a third embodiment of a separating device, the device being separate from the mixing shaft and mounted parallel to this shaft.
Figure 5:
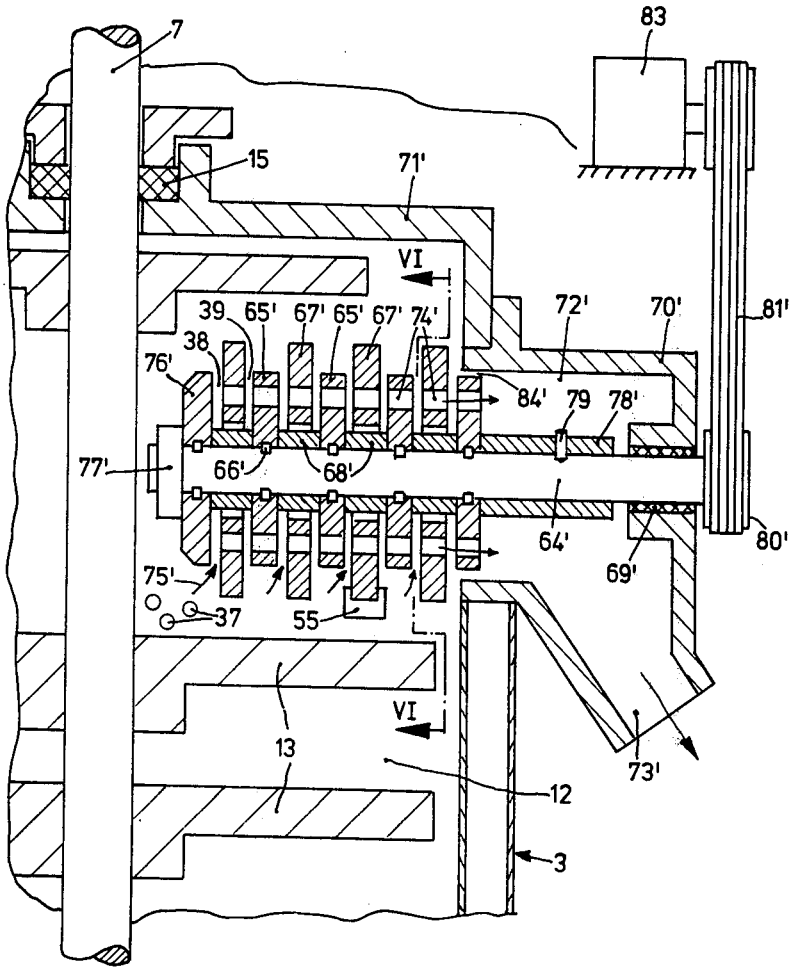
FIG. 5 is an axial cross-sectional view of a fourth embodiment of a separating device, the device being mounted on a shaft separate from the mixing shaft and mounted perpendicular thereto.

The embodiments shown in FIGS. 4 and 5, the respective separating devices 18 differ from the embodiments shown in FIGS. 2 and 3 mainly by virtue of the fact that the annular disks are mounted on a separate shaft 64 or 64'; the shaft 64 or 64' is mounted either parallel to the mixing shaft 7 (FIG. 4) or at an angle, shown as a right angle, to the latter (FIG. 5). Insofar as the design used in FIG. 5 is substantially similar to that of the embodiment shown in FIG. 4, the same reference numbers are used for FIG. 5, but are marked with a prime (').

As in the embodiment in FIG. 2, axially nondisplaceable annular disks 65, 65' are mounted nonrotatably on a shaft 64, 64' by means of a key connection 66, 66'. Between two adjacent axially nondisplaceable annular disks 65, 65', axially freely movable annular disks 67, 67' are once again provided, these disks also being mounted in a radially floating manner. Between each of the axially freely movable annular disks 67, 67' and the adjacent axially nondisplaceable annular disks 65, 65' on either side, the annular spaces 38, 39 are formed in accordance with the same principles described above for FIG. 2. In order to ensure limited axial mobility for annular disks 67, 67', spacing rings 68, 68' are mounted on a shaft 64, 64' between each two adjacent axially nondisplaceable annular disks 65, 65'. The shaft 64, 64' is mounted rotatably and axially nondisplaceably by means of bearings 69, 69' in a bearing sleeve 70, 70', this bearing sleeve being mounted on a cover 71, 71' of the grinding container 3. Between the bearings 69, 69' and the annular disks 65, 65' adjacent to them, a ground-stock collecting space 72, 72' is formed, from which a ground-stock outlet connection 73, 73' originates. The annular disks 65, 65' and 67, 67' are also provided with apertures 74, 74', through which the ground stock can flow along the flow direction indicated by arrows 75, 75' from the grinding space 12 after passing through the annular spaces 38, 39 into a ground-stock collecting space 72, 72'. An annular disk 76, 76', which is located farthest from the bearings 69, 69' and is axially nondisplaceable, as in the embodiments described hereinabove, is not provided with the apertures 74, 74'. On the free end of the shaft 64, 64' which located in the grinding container 3, a locknut 77, 77' is screwed, by means of which nut the assembly of the axially nondisplaceable annular disks 65 and 76, 65' and 76' and the spacing rings 68, 68′ is axially immobilized in one direction, while it is held in place in the other direction by a spacing bushing 78, 78′, this bushing either resting against the bearing 69 (FIG. 4) or fastened to the shaft 64′ (FIG. 5) by a set screw 79.

A V-belt pulley 80, 80′ is mounted on the outer end of the shaft 64, 64′, this pulley either being driven directly by V-belts 81 from a V-belt pulley 82 mounted on the mixing shaft 7 (FIG. 4), or driven by a drive motor 83 by a V-belt 81′ (FIG. 5). The drive can also be omitted completely so that the shaft 64, 64′ is turned manually at intervals. Moreover, the shaft 64, 64′ can also be mounted nonrotatably, so that in this case only the annular disks 67, 67′ rotate as a result of the rotation of the grinding stock.

As has already been described in the case of the embodiment shown in FIG. 2, the axially freely movable annular disks 67, 67′ have a greater diameter than the axially nondisplaceable annular disks 65 and 76, 65′ and 76′, so that the axially freely movable annular disks 67, 67′ are braked by the flow of grinding stock against the forcibly driven annular disks 65 and 76, 65′ and 76′. In addition, the tools 55, which act as surfaces exposed to flow, can be provided on the outer circumference of the axially displaceable annular disks.

In the embodiments shown in FIGS. 4 and 5, of course, space 84, 86′ between the bearing sleeve 70, 70′ and the annular risk 65, 65′ which is adjacent to the bearing 69, 69′ must be smaller than the diameter of the smallest particle of grinding medium 37 used.

Figure 6:
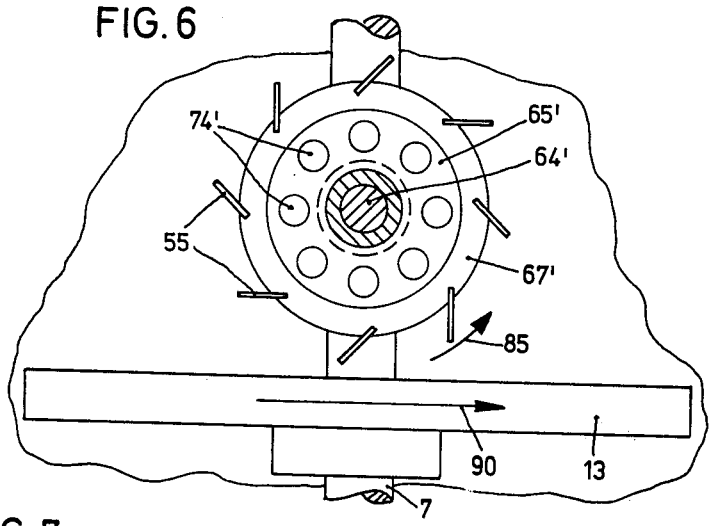
FIG. 6 is a sectional view of the separating device of FIG. 5, the section having been taken along section line VI—VI.

As indicated by FIG. 6, the axially freely movable annular disks 67′, which are freely rotatably relative to the shaft 64′, receive a rotation impulse by virtue of the fact that one of their sides (the lower side) is located relatively close to the mixing tool 13, which rotates in rotational direction 90, whereby the flow of grinding medium which occurs in the vicinity of mixing tool 13, in accordance with the flow direction indicated by an arrow 85, has a greater influence upon the annular disks in this area than in the area which was located further from mixing tool 13. If the other annular disks 65′ and/or 76′ are forcibly driven, this results in a braking of the annular disk 67′, while in the event that the annular disks 65′, 76′ stand still with the shaft 64′, the annular disks 67′ will be driven by the forces resulting from the mentioned flow of the grinding medium. This effect is even further intensified by making the drivers 55 slope relative to flow direction 85. The development of the effect described above is the same for the other embodiments shown.

Figure 7:
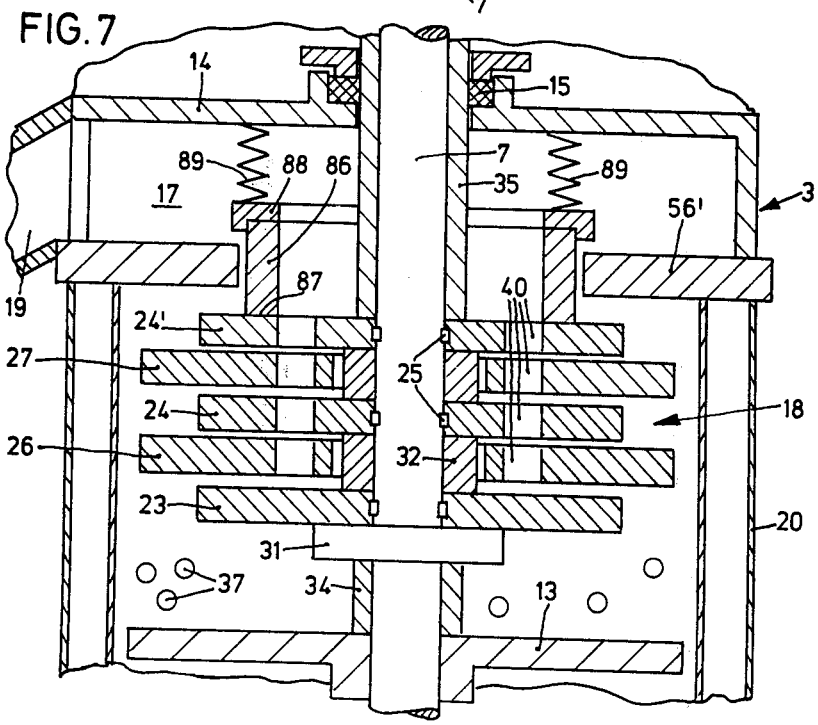
FIG. 7 is an axial cross-sectional view of a variant of the separating device of FIG. 2, the device being provided with a slip ring seal.

FIG. 7 shows further details of a variant of the embodiment shown in FIG. 2, to wit, an additional axially nondisplaceable annular disk 24′ is disposed above the upper axially and radially freely movable annular disk 27. On the upper side of this annular disk 24′, there is a radially divided slip ring 86, which leaves no space between its sliding surface 87 and the corresponding surface of annular disk 24′. The slip ring 86, of course, is mounted sufficiently far outward so that the grinding stock can flow freely into the ground stock removal space 17 through the apertures 40 and the space between the slip ring 86 and the spacing bushing 35. The two halves of the ring 86 are held in a holding ring 88 which extends above them, this ring being subjected to pressure from above by means of a pretensioned pressure spring 89, this spring bearing against the cover 14 of the grinding container 3. When the slip ring 86 is worn, the cover 14 need only be removed from the grinding container 3, and two new slip ring seal halves inserted. Therefore, no disassembly work of any kind is required. Of course, such a seal, consisting of a divided slip ring, can also be used in rotating separating devices of other designs. If an axial space shown considerably enlarged in FIG. 7, is provided between the lower sealing wall 56′ of the ground stock removal space 17 and the slip ring 86, something which can be avoided, this axially extending space likewise in no case must be greater than the diameter of the smallest particle of grinding medium 37 used so as to prevent particles of grinding material from entering the space and clogging the mill. Moreover, such a space will be established immediately during operation, since neither the sealing wall 56′ nor the slip ring 86 rotate relative to one another, but the slip ring 86 is axially movable relative to the sealing wall 56′.

It is expressely pointed out that in the drawings illustrating the embodiments, the spaces and the grinding media are shown very much enlarged relative to the other components, in order to achieve the necessary clarity.

It is to be appreciated that the foregoing description and accompanying drawing illustrations have been set out by way of example, not by way of limitation. Other embodiments and variants are possible without departing from the spirit and scope of the invention, its scope being defined by the appended claims.

What is claimed is:

1. In a stirring mill with fine grinding and/or dispersal of flowable grinding stock, the mill including a grinding container provided with a mixing shaft rotatably drivable and fitted with mixing tools; grinding stock inlet means in the vicinity of one end; a ground stock outlet means in the vicinity of the other end; and a separating means disposed in front of the ground stock outlet means to hold back grinding medium located in the grinding container, said separating means being formed by rotatable annular disks defining spaces between them which extend radially outward with respect to said shaft, said annular disks being mounted concentrically on a shaft, and the width of the spaces being smaller than the diameter of the smallest particle of grinding medium to be used, the improvement wherein some of said annular disks are axially nondisplaceable, are fixed to said shaft and are rotatable therewith, a respective axially freely movable annular disk disposed about said shaft, between each two of said axially nondisplaceable annular disks and having apertures therein, those of said disks which are fixed to said shaft and also are between said axially movable disks also having apertures therein, and the sum of widths of two spaces delimited by said axially movable annular disk is smaller than the diameter of the smallest particle of grinding medium to be used.

2. An improved stirring mill according to claim 1, including spacing rings disposed respectively between adjacent ones of said disks which are fixed to said shaft whereby space of mutually adjacent said axially nondisplaceable annular disks is determined by said spacing rings, said spacing rings being removable spacing rings.

3. An improved stirring mill according to claim 1, wherein said axially nondisplaceable annular disks are non-rotatably connected to a shaft supporting them.

4. An improved stirring mill according to claim 1, wherein said axially movable annular disks are freely rotatable relative to a shaft supporting them.

5. An improved stirring mill according to claim 4, wherein said annular disks which are freely rotatable relative to said shaft on which they are mounted have a diameter greater than those of said annular disks which are not freely rotatable.

6. An improved stirring mill according the claim 5, wherein said axially freely movable annular disks are provided with drivers on their outer circumference.

7. An improved stirring mill according to claim 1, wherein some of said axially movable annular disks are tangentially mounted relative to said grinding container.

8. An improved stirring mill according to claim 1, wherein said annular disks are mounted on said mixing shaft.

9. An improved stirring mill according to claim 1, wherein said annular disks are mounted on a shaft separate from said mixing shaft.

10. An improved stirring mill shaft according to claim 9, wherein said shaft separate from said mixing shaft is mounted at an angle to said mixing shaft.

11. An improved stirring mill according to claim 9, wherein said separate shaft is driven by said mixing shaft.

12. An improved stirring mill according to claim 9, including a shaft separate from said mixing shaft and which supports said annular disks.

13. An improved stirring mill according to claim 1, wherein said annular disks with the exception of that one of said annular disks which is furthest from said ground-stock outlet means are provided with apertures for passing grinding medium.

14. An improved stirring mill according to claim 1, wherein said axially movable annular disks are mounted in a radially floating manner on said shaft supporting them.

15. An improved stirring mill according to claim 1, including a radially divided slip ring provided as a seal against an uppermost one of said annular disks, said uppermost disk being connected to said shaft so as to be driven thereby, axially nondisplaceable, and located next to said ground-stock outlet means.

16. An improved stirring mill according to claim 1, wherein at least some of said annular disks which are axially nondisplaceable are provided with apertures.

* * * * *